US006190106B1

(12) United States Patent
Richardson et al.

(10) Patent No.: US 6,190,106 B1
(45) Date of Patent: Feb. 20, 2001

(54) APPARATUS FOR UNLOADING OPEN TOP RAILROAD CARS

(76) Inventors: Melvin A. Richardson, 5047 Labrador Dr., Roanoke, VA (US) 24012; James M. Hoye, 203 Whitcomb Dr., Goode, VA (US) 24556

( * ) Notice: Under 35 U.S.C. 154(b), the term of this patent shall be extended for 0 days.

(21) Appl. No.: 09/168,245

(22) Filed: Oct. 8, 1998

(51) Int. Cl.[7] ..... B65G 67/02
(52) U.S. Cl. ..... 414/339; 414/333; 414/537
(58) Field of Search ..... 414/339, 537, 414/394

(56) References Cited

U.S. PATENT DOCUMENTS

| | | | | |
|---|---|---|---|---|
| 4,099,635 | * | 7/1978 | Leonard et al. | 414/800 |
| 4,479,750 | * | 10/1984 | Johnson, Jr. | 414/339 X |
| 4,723,886 | * | 2/1988 | Frederking | 414/339 |
| 4,730,974 | * | 3/1988 | Andre | 414/537 X |
| 4,995,129 | * | 2/1991 | Comardo | 414/537 X |
| 5,066,188 | * | 11/1991 | Bush | 414/339 |
| 5,133,634 | * | 7/1992 | Gingrich et al. | 414/537 |
| 5,183,369 | * | 2/1993 | Warren, Jr. et al. | 414/339 |
| 5,553,989 | * | 9/1996 | Ullman | 414/537 |
| 5,628,606 | * | 5/1997 | Herzoe et al. | 414/339 |
| 5,733,091 | * | 3/1998 | Long | 414/537 X |

FOREIGN PATENT DOCUMENTS

| | | | | |
|---|---|---|---|---|
| 6715907 | * | 5/1969 | (NL) | 414/537 |

* cited by examiner

*Primary Examiner*—Steven A. Bratlie
(74) *Attorney, Agent, or Firm*—James W. Hiney

(57) ABSTRACT

An apparatus for unloading open top railroad cars, especially hopper cars, comprising a crawler excavator having a pair of tracked treads and a hinged arm with a bucket thereon able to rotate a fill 360 degrees and to move forward and rearward atop the open top railroad cars, an attachment on the crawler with side extensions to hold the crawler atop the rail cars due to the side extensions slidably resting atop the sides of the rail cars and a portable ramp by which the crawler excavator can mount the ends of the cars.

17 Claims, 11 Drawing Sheets

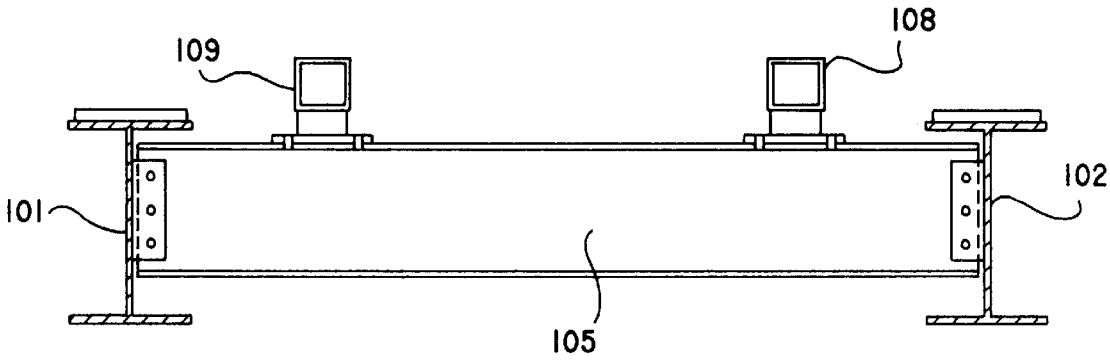
FIG.12
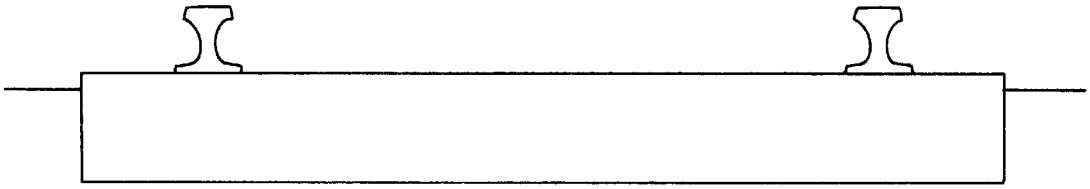
FIG.13
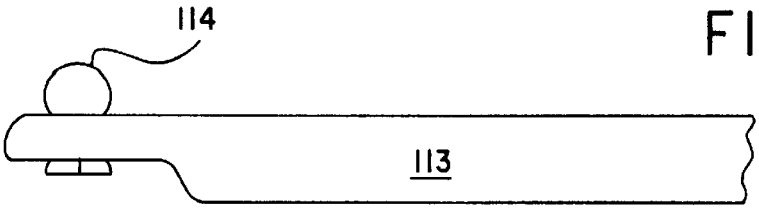

APPARATUS FOR UNLOADING OPEN TOP RAILROAD CARS

THE FIELD OF INVENTION

The present invention is directed to an apparatus for loading and unloading open top railroad cars containing bulk material such as coal, sand, rocks, gravel or a form of grain. The invention utilizes standard unloading and loading equipment coupled with a unique apparatus which facilitates the use of the standard equipment thus reducing the need for specialized equipment at trackside.

THE PRIOR ART

Railroads use open top cars to haul a variety of bulk cargo. Among the types of cars are hopper cars which may have 2, 3 or 4 bays in which the bulk cargo is adapted to be unloaded by chutes in the bottom of each bay. Another type of railroad car used to haul the bulk cargos is the ore car which may have an unloading chute at the base of its structure. The third type of railroad car which hauls, on occasion, bulk cargo, is the gondola car which usually has much shorter sides than hopper cars and is used to haul a variety of cargo, not just bulk. The ore and hopper cars have high sides, usually reinforced to keep the pressure of the bulk ore or coal from pressing outwardly and caving in the sides. Some cars must be rotary dumped or unloaded from the top.

Both discrete products, such as lumber products, metal ingots, and products made discrete by packaging as in bags or the like, and particular, fungible products, such as sand, coal, gravel and grain are frequently transported in open top containers such as railway gondola cars.

In the prior art, the unloading of open top containers such as hopper and gondola cars has presented a variety of problems which have been dealt with by differing techniques in different situations. The techniques of the prior art for unloading open top containers such as gondola cars include manual unloading, the use of car dumpers, and the use of cranes, shovels, or the like, for unloading of railway gondola cars, the prior art includes the use of a crane fixedly positioned alongside the railway tracks for unloading cars which are successively brought alongside the crane by being propelled along the track, the use of cranes, shovels, or backhoes supported atop fixed frame members which straddle railway tracks and the cars running thereon to permit the material handling machine atop the frame to unload the cars contents as they run beneath the frame member, and the use for shovels, backhoes and the like installed upon moveable underframe members which straddle the tracks and support the material handling equipment at a height exceeding the height of the car being unloaded. Some ore and hopper cars are designed to be unloaded either by opening chutes on the bottom of their compartments or by being turned upside down with the section of track it is sitting on in a huge unloader which rotates 180 degrees. That is the ideal situation but in most cases such an unloader or use of the chute is not practical, the latter case because it requires a complex structure underneath the track that the bulk cargo can pour into as it comes out of the bottom of the hopper or ore car.

When such equipment is not available, railroads and shippers have turned to expensive trackside unloading equipment such as large traveling cranes similar to those that unload the holds of ships or stationary cranes able to pivot over the hopper cars. Such facilities are usually found at the shippers facility, at a major coal loading operation, at a terminal at the dock for bulk being shipped by boat or at a major railroad yard.

In a great deal of the cases, such unloading equipment is just not available and with new shippers of bulk and buyers of that bulk cargo coming on line constantly there is a need for a simple, inexpensive loading and unloading apparatus which will do the job quickly and cheaply. There have been several attempts to provide such an apparatus before the instant invention became available.

In U.S. Pat. Nos. 4,190,394, 4,175,902 and 5,527,144, all issued to Herzog et al a method and apparatus for unloading railroad cars using a backhoe-loader with rubber tires is disclosed. The Herzog device incorporate powered hydraulic arms permanently attached to the backhoe for keeping it on top of the hopper car. The arrangement is clumsy and very expensive as it requires the backhoe manufacturer to provide the attachment to the equipment. A standard backhoe cannot be used as it does not have the attachments. In addition a front bucket winch is required in the device. In the '144 patent, Herzog et al attempt to improve the design with the addition of a single center beam underneath the backhoe to improve stability. The result is a complex, expensive piece of equipment which it would be difficult to use and is designed for a backhoe, not a crawler, as in the instant invention.

In U.S. Pat. No. 4,7223,886 and 4,830,562 to Frederking, there is shown a crawler unloader device for unloading railroad cars. The neb of the invention is essentially the provision of a special tracing arrangement which allows the tracks 35,36 of the crawler to expand outwardly so as to engage the top edge of the car being unloaded. Again, this is a very expensive alteration to a standard crawler and has never been built due to the costs involved.

U.S. Pat. No. 5,037,264 discloses hydraulically operated load handling vehicle which has several sets of wheels and two cranes and is designed to be operated in either direction. Each set of wheels is controlled by a hydraulic arm which raises one of the set so as to enable the vehicle to cross between two cars. Such a device is obviously complicated and has never been built.

A device similar to the preceding patent is that disclosed in U.S. Pat. No. 4,096,954 for a railroad car unloader. It uses two sets of wheels which incorporate rollers such as 138 and 158 to roll along the top edges of railroad cars. Hydraulic clamps such as 122 hold the car in place while the operation of unloading is proceeding.

The U.S. Patents to Warren et al, U.S. Pat. No. 5,320,474 and U.S. Pat. No. 5,342,159 show a system which uses a crawler type crane to unload railroad cars. The crawler runs atop the car via a ramp 43 and then positions pallets such as 13 atop the car. The pallets are adjustable horizontally to engage the inner sides of the car. At least two pallets are necessary as the crawler has to pick up the pallets and place them in front of itself as it moves along the top of the car. Such as system is awkward and cumbersome as it requires several pallets and the step of moving and locating the pallets each time the crawler has to move.

The U.S. Patent to Mellious, U.S. Pat. No. 4,128,180, utilizes an arrangement similar to that shown by Herzog in his three patents, namely, a complex system of hydraulically operated clamps that enable a backhoe to unload railroad cars. The patent seems to provide only a means of allowing the backhoe to be loaded atop the cars, namely in the provision of a skid-plate underneath the equipment which allows it to be slid over the end edges of the cars.

U.S. Pat. No. 5,066,188 to Bush shows a combination loading ramp and support frame used in conjunction with a crawler type unloader to position the unloader atop a railroad car to be unloaded. The frame has a winch 30 which pulls the ramp up with the crawler device atop it although from an examination of the configuration there is a serious question as to whether it would function as described. The patent recites how the frame is attached to the tracks of the crawler by pins 38 and then the bucket 64 elevates the whole structure up level with the top of the car and the winch pulls it sideways after hook 34 is engaged with the opposite end of the car. The width of the frame is adjustable through hydraulic means 24 ,26. The device seems inoperable as when the wince is engaged, the bucket would dig into the ground (if the car is at the end of a siding) or be engaged between the track ties. If the bucket would be swung to one side it would create an instability that would seem to topple the crawler and attached frame sideways. There is no satisfactory explanation of how the crawler "gets down" from atop the car. It would seem that the same problem arises, namely the inherent instability of the structure as one is attempting to edge the frame out over the end of the car. It does not say if the winch is reversible which it would have to be if one wished to unload over the same car end as before.

Each of all the prior art unloading techniques is quite expensive, and presents other disadvantages in various operations. Manual unloading is prohibitively expensive in terms of labor cost. The use of a car dumper requires huge capital expenditure for the device which requires a large space for it construction and use, limits car unloading to the point at which the dumper device is located thereby creating a large pile of cargo at a single location which must, in most cases, be retransported by other conveyances. Plus the cost of demurrage of railroad cars is very high and the goal is to get them unloaded as quickly as possible. Similarly, the use of a crane positioned alongside the tracks and the use of material handling equipment located atop the fixed frame members straddling the tracks involves a substantial capital outlay and limit the unloading of cargo to the point where the crane is located with all the same attendant problems. The use of a fixed underframe structure for straddingly supporting material handling equipment above railway trackage and the cars thereon permits material to be off loaded from the cars alongside each car rather than at a single point and would further permit a reasonable additional spacing of the off-loaded cargo, if desired, by moving the train from time to time, and moving the unloading apparatus above the train to unload each car at the point at which it is desired to unload that car. The problem with this is the moveable track straddling structures are massive and are accordingly highly fuel inefficient vehicles capable of moving a miniscule speeds and therefore not practical when it is desired to speedily unload cars at widely dispersed locations.

Another need of railroads is to have a simple unloading system for their maintenance crews which service thousands of miles of track each year. Continuous maintenance is required each year on right-of-ways and the instant invention lends itself to such maintenance operations. The equipment forming the invention herein can be used to unload gondola cars full of railroad ties, for example. Usually a maintenance crew works with several gondola cars of replacement ties just in from the treatment plant. A high side gondola car typically holds 400 or more ties so to try to manually unload them is time consuming and requires 4 to 5 men.

Due to the problems with the fixed or semi-fixed unloaders and either the inherent design flaws or huge expense in constructing the equipment shown in the cited U.S. Patents, the industry has been looking for a cheap, simple method and apparatus which would accomplish the goal of unloading quickly, cheaply and efficiently at widely separated locations without major capital outlays. The present invention solves the problem at a minimum cost and is transportable from location to location. The equipment itself is standard, such as the excavators on tracks, known as excavators, produced by companies such as John Deere.

OBJECTS OF INVENTION

Accordingly, it is an object of this invention to provide a simple, inexpensive method and apparatus for loading and unloading cargo from open top railroad cars.

It is another object of this invention to provide a unique attachment to a conventional material handling piece of equipment to enable it to simply and quickly unload cargo of either a discrete or fungible nature.

Another object of this invention is to provide a unique system for loading or unloading open top railway cars which is portable and self sustained.

It is yet another object of this invention to provide an attachment for conventional loaders such as backhoes, excavators, or the like whereby it may support itself atop an open top car while unloading the cargo therein.

Yet another object of this invention is to provide a trailer for open top railway car unloading equipment which additionally serves as a ramp for allowing the equipment to mount such a car.

A further object of this invention is to provide such method and apparatus wherein the items of material handling equipment can be mounted upon the open top of a railway car and move along said car top on its own power without use of additional winches or support equipment or the like.

A still further object of this invention is to provide a unique cargo unloader for open top railway cars that can be utilized by a simple bolting on or "strapping" of a support frame without any further modification.

Another object of this invention is to provide a simple loading and unloading system which may be used by railroad maintenance crews.

These and other objects will become apparent when reference is had to the summary of invention, the drawings and the detailed description.

SUMMARY OF INVENTION

This invention involves the use of a simple system which allows standard excavating or unloading equipment, such as excavators and backhoes, to be used to unload and load both discrete and fungible cargo from the top of open top railroad cars such as hoppers and gondolas. The system is shown as applied to a excavator with tracks but can be used equally with a wheeled backhoe.

The system involves the use of a support frame which is secured to the underside of a piece of unloading equipment such as a crawler. A mobile loading ramp is used in conjunction with the equipment and is used as a trailer to transport the equipment from location to location. The frame consists of two outrigger beams which are adapted to engage and slidably rest upon the tops of the sides of an open top railway car. Mounted on the ends of the beams are plates which guide the beams as they slide along the car top and slide plates which afford a sliding surface to facilitate the easy movement of the frame and equipment to which it is mounted. The width of the outrigger beams can be made adjustable if desired by providing telescoping sections with tightening bolts. The beams are connected by longitudinal beams which connect at multiple locations to provide a sturdy frame. Mounted atop this configuration are pair of bracket moldings which are adapted to receive bolts which mount the frame to the underside of the unloading equipment. The important point in the mounting of the frame is that its lowest point adjacent the equipment is higher than the track so as to allow the equipment to move along its tracks or tires without interference from the frame as it moves up the ramp. This configuration allows the equipment to pull itself along atop the car by operation of its bucket by digging it into the fungible cargo or by hooking the end of the car. There is no need for a winch to move the equipment nor, due to the strength of the outrigger beams and the slide plates, any need for rollers or the like. The frame is, as constituted, very simple to attach and detach from the equipment for adjustment or repairs of the equipment or to transfer from one "stock" machine to another.

The ramp which also serves as the trailer for the equipment is comprised to two parallel beams connected by interspersed I beams and which has a pair of guide rails thereon which guide the tracked or wheeled equipment up the ramp to prevent it from getting too near the edge and tipping over. The tail end of the ramp has a foldable section to facilitate the ramp to ground transition. The other end of the ramp has a connection with a hooking configuration thereon. The configuration is engaged with another trailer portion which has the standard trailer hookup for trailing and is detached when the ramp is used to facilitate loading of the equipment atop railway cars. The equipment itself is used to elevate the ramp and allow the hooking configuration to engage the top edge of the end of the last open top car to be loaded or unloaded. The equipment then simply drives up the ramp until the attached underframe engages the car top side edges and tracks engage the load then propels itself along by digging its bucket into the cargo or by grabbing onto various parts of the same or adjacent railcar. It goes from car to car as the length of the underframe is sufficient to span the typical distance between cars and by pulling on the bucket it merely continues along without interruption. The tracks of the crawler can be used to lift the equipment slightly when it edges from one car to another as can the tires of a backhoe. The depth of the mountings on the ends of the outrigger beams are sufficient to keep the apparatus centered as it moves along each car and in the movement of car to car.

The configuration of the invention allows the equipment a full 360 degree turning ratio and hence it can be used to unload to either side of the open top car. In addition, several of these pieces of equipment may be used in a long coal train in a siding as one of the drawings herein depicts. Each piece of equipment may travel up the ramp and start working several cars from the end car thus facilitating the loading or unloading process. One of the drawings which is a photograph shows two crawlers working several cars at once.

THE DRAWINGS

FIG. 11 shows a side view of the end of the ramp hooking configuration and the typical degree elevation it is used at.

FIG. 12 shows a cross sectional view of the ramp taken along lines D—D of FIG. 9 and its relation to the railway track.

FIG. 13 shows the end of the detachable trailer portion the other portion of which is shown in FIG. 10.

DETAILED DESCRIPTION OF THE INVENTION

Figure 1:
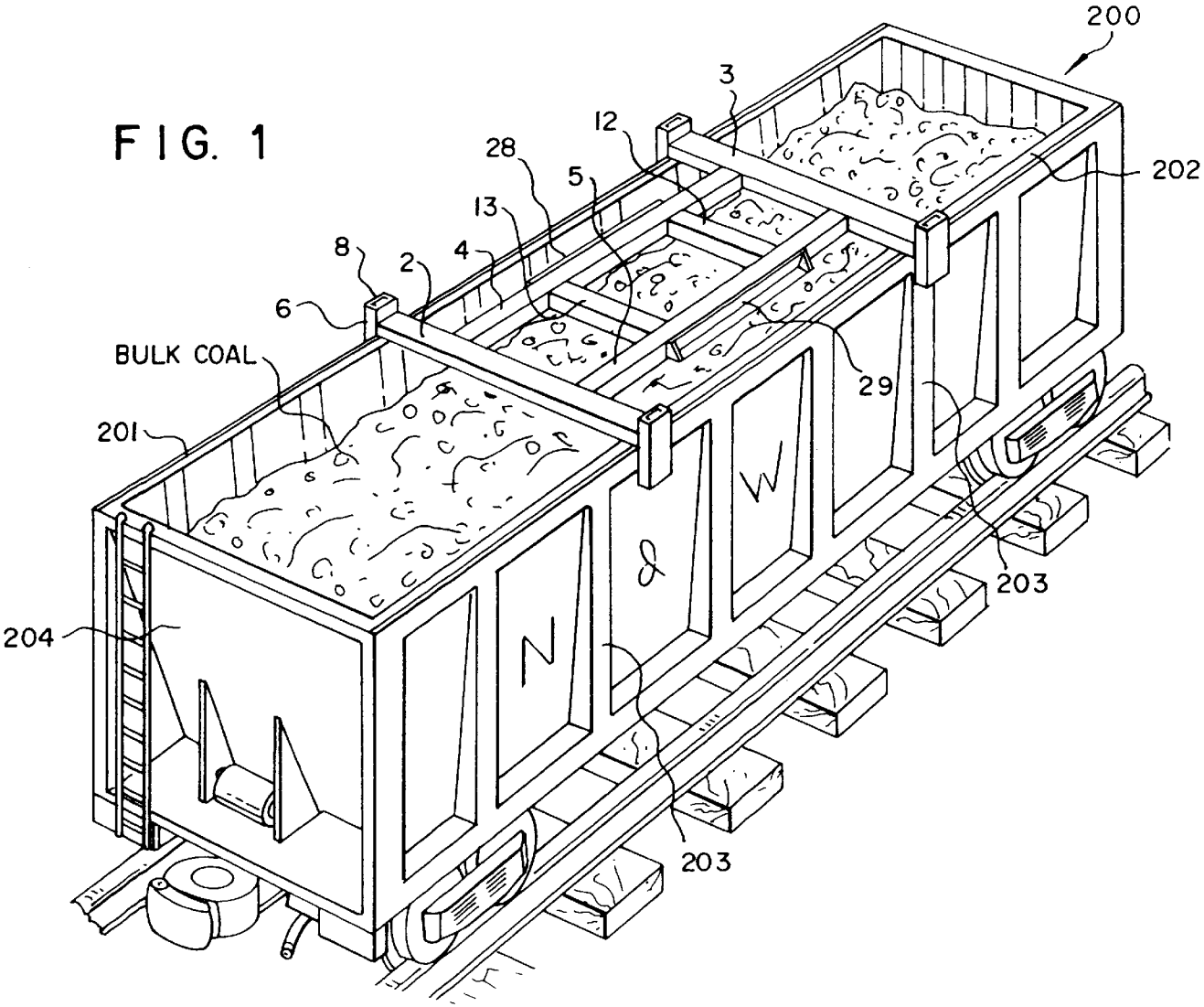
FIG. 1 is a three dimensional view of a hopper car with just the underframe shown in position with the unloader equipment attached thereto.

Referring to FIG. 1 there is shown a open top railroad car 200 which, for the purposes of this invention, can be any open top railroad car with steel or similarly strong reinforced sides such as a hopper car with various bay configurations, an ore car or a gondola car. The car shown is a hopper car with a load of coal therein although the load can be any discrete or fungible load. It has ends such as 204, which sometimes are sloped as shown here to allow the coal to slide out the hopper bay chute if, indeed, car has one. It has reinforced sides such as shown at 203 and tops of sides 201 and 202. The reinforcing helps resist the outward pressure of the bulk cargo. Mounted atop the car 200 is a support frame having outrigger beams 2 and 3 joined together by longitudinal beams 4 and 5. Cross struts 12 and 13 join the longitudinal members together and there are elongated brackets 28 and 29 by which the frame assembly is bolted to the underside of whatever unloading or loading equipment one is using, in the case of the illustrations shown in this application, a crawler with tracks having treads.

Figure 2:
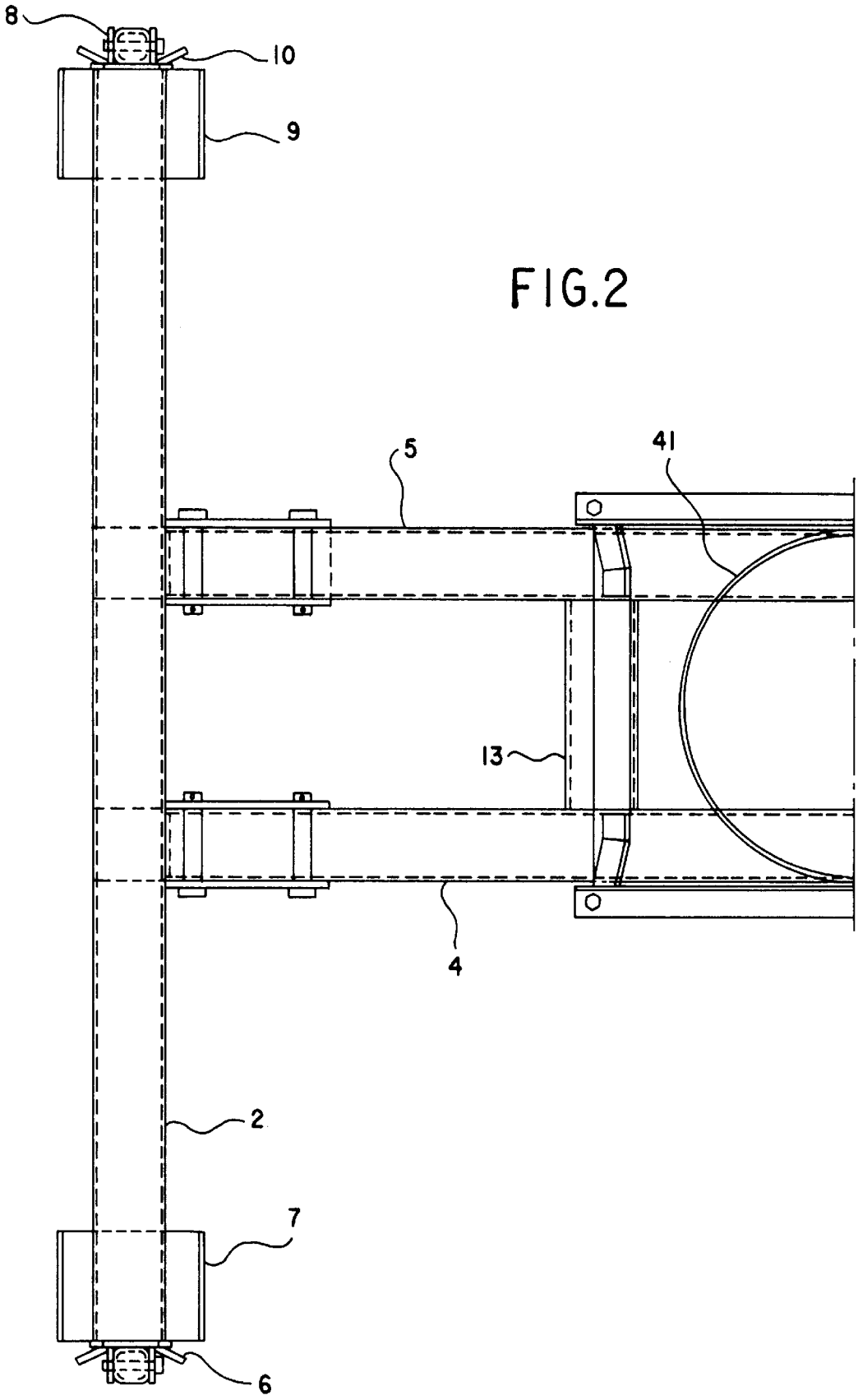
FIGS. 2 and 3 show the plan view of the frame support and should be viewed together with the arrows showing where the views connect.
Figure 3:
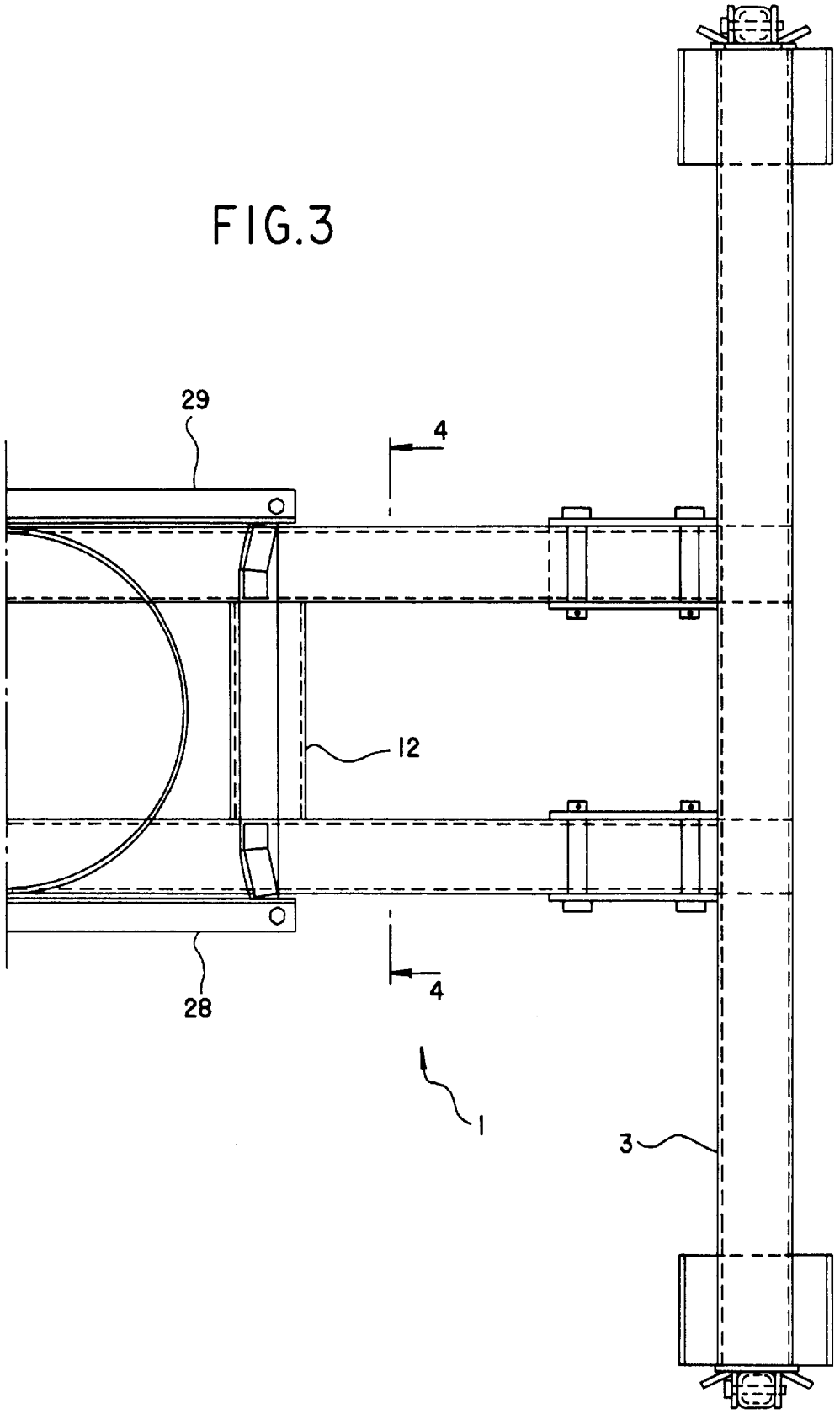
Figure 4:
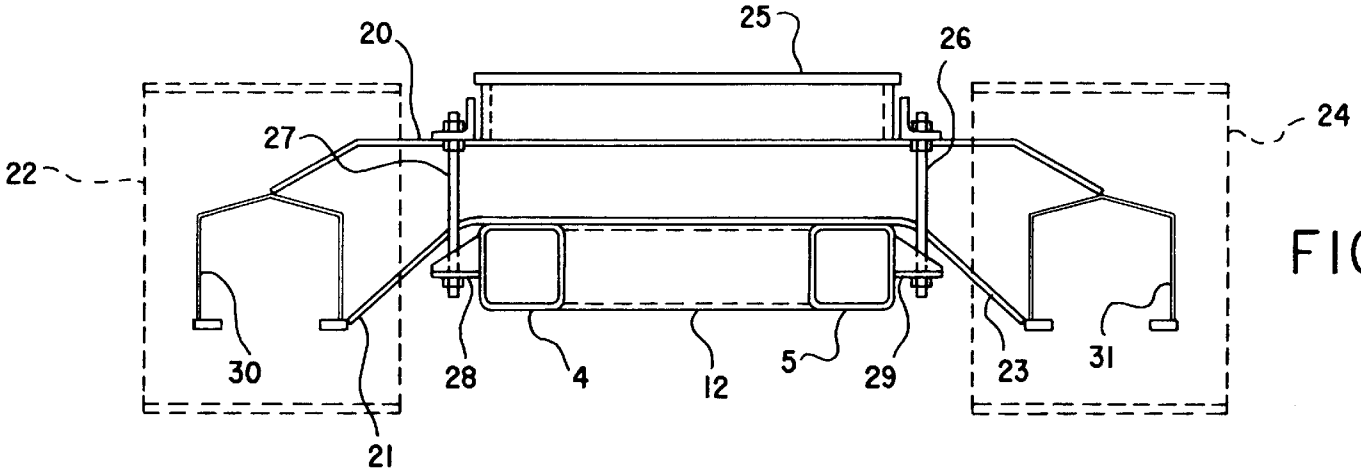
FIG. 4 shows a cross sectional view of the frame bolted to equipment taken along line A—A of FIG. 2.

In FIGS. 2 and 3, which should be taken together, there is shown a plan view of the support frame with outrigger beams 2 and 3 made of channel steel as well as longitudinal beams 3 and 4 made of the same material. The ends of the outrigger beams 2 and 3 have end pieces 8 welded thereto with a side flange plate 6 and a skid plate 7. The flange plate keeps the members from hanging up on any projection on the side of the cars and skid plate 7 allows the whole assembly to slide along when pushed or pulled by the action of the hydraulic arm on the crawler. The bucket is the anchoring point and the operator merely backs the crawler on the assembly up or pulls it forward based on what direction he is working. FIG. 4 shows a cross section of the device taken along lines A—A and one can see the strut 12 with the longitudinal beams 4 and 5. Bolts such as 26, 27 are used to bolt the support frame by elongated brackets 28, 29 to the underside 25 of the crawler. The crawler configuration is shown by portions 21, 23 extending outward and forming enclosures in which the track mechanism (not shown) is positioned for driving the track treads 22, 24, shown in dotted lines. It can be seen that the entire assembly is simple and yet strong to support the weight of the crawler itself. Once the crawler is on the railroad car the treads will soon lose support of the coal or like cargo and will not be able to propel the crawler forward. When that occurs the operator merely hooks the unloading or loading bucket into the pile or on the end of the car or on interior bracing and propels the equipment in the direction desired.

Figure 5:
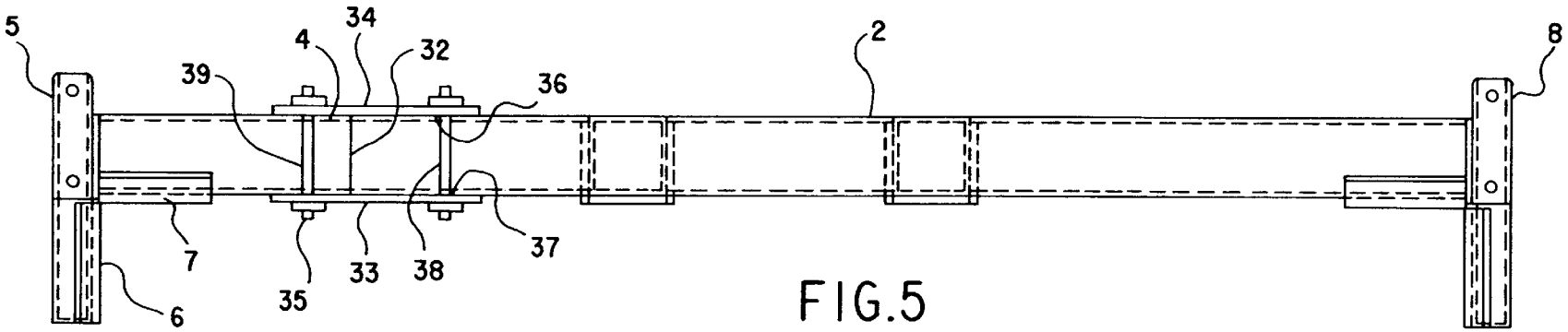
FIG. 5 shows an end view of the support frame.

FIG. 5 shows the end view of the support frame with the outrigger beams extending to either side. The outriggers may be adjustable horizontally as shown by a break 32 in the beam over which is a telescoping sleeve 33 which has an opposite side 34 and bolts 38, 39 extending therethrough with heads 35 and nuts 40. The bolts pass through slots such as 36, 37 which allow the break between the ends of beam 2 to be adjusted to whatever width the railroad car is. Once set the bolts are tightened and the width is set. The ring 41 is the mount upon which the upper end of the crawler rotates 360 degrees.

Figure 6:
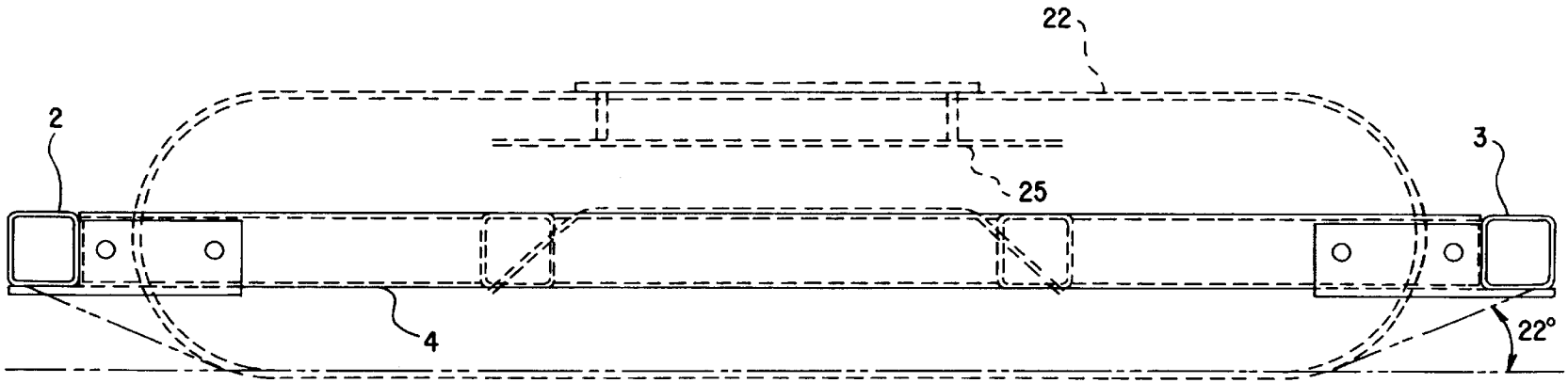
FIG. 6 shows a side view of the support frame showing the track profile in relation to the frame.

FIG. 6 shows the support frame in profile with the treads 22 in dotted lines to show the relationship. The frame is high enough to allow the treads to power the equipment up a ramp on its own power and then to scoot along inside of car by either its own power initially (when the load is high enough within the car to allow for this) or by pushing or pulling by its bucket when enough of the load has been unloaded to allow the frame to engage the car edges and support the equipment. The angle at which the equipment ascends the ramp can be set at 22 degrees for hopper cars and less for gondola cars.

Figure 7:
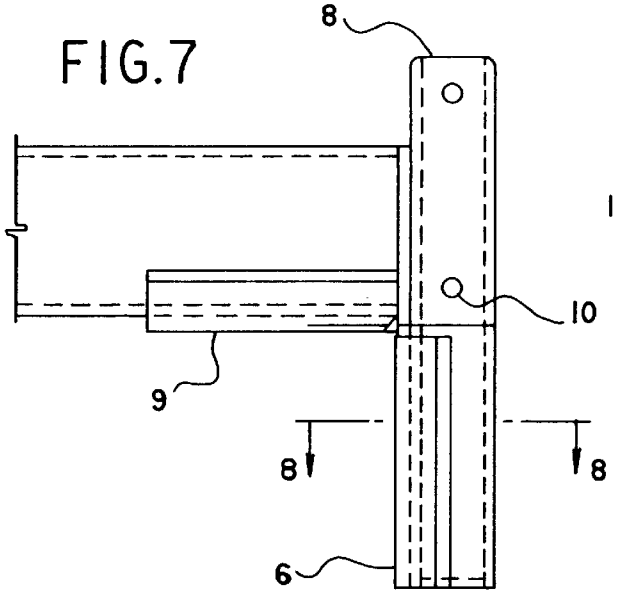
FIG. 7 shows the detail of the end configuration of the outrigger beams.
Figure 8:
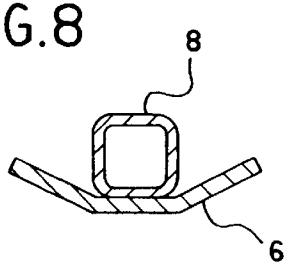
FIG. 8 shows a cross section view of the end detail taken along line C—C of FIG. 7.

FIGS. 7 and 8 show the detail of the ends of the outriggers with members 8 pinned by a removable pin to the end of the beams and flange plates 6 and skid plates 7 welded thereon. Members 8 are designed to fold back to facilitate travel of the excavator when not on a railcar or ramp.

Figure 11:
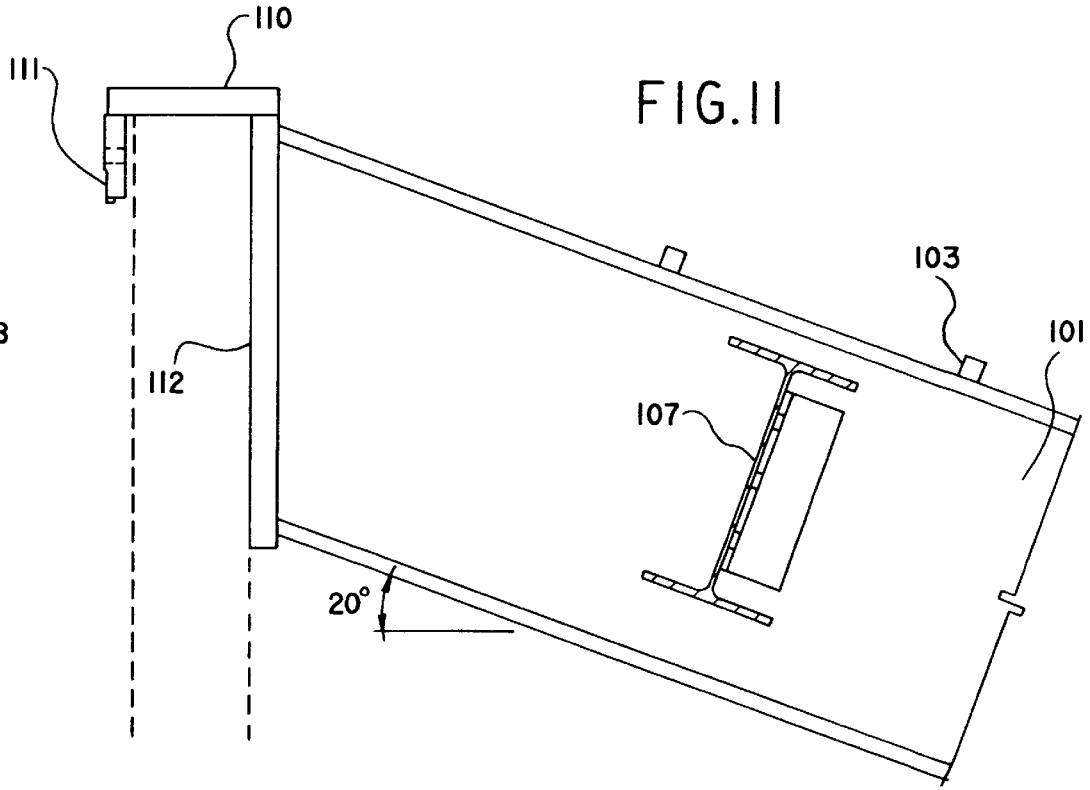
Figure 9:
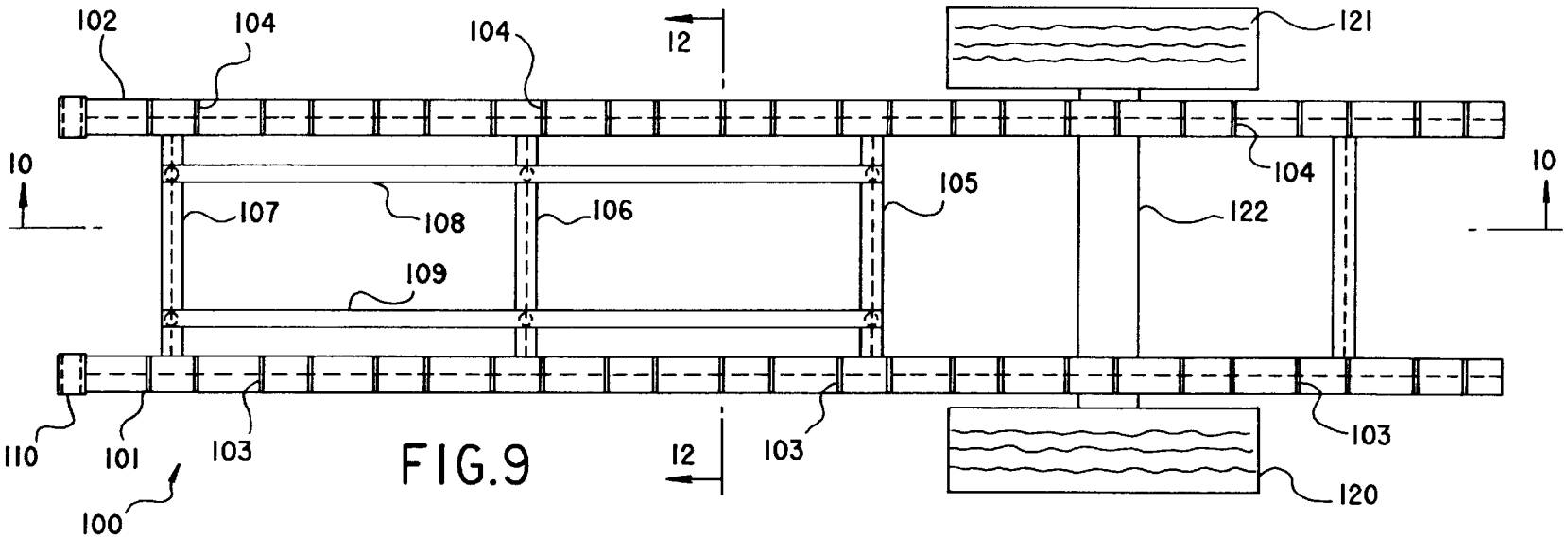
FIG. 9 shows a plan view of the ramp used to transport the equipment and to allow loading of the equipment atop the railway cars.
Figure 10:
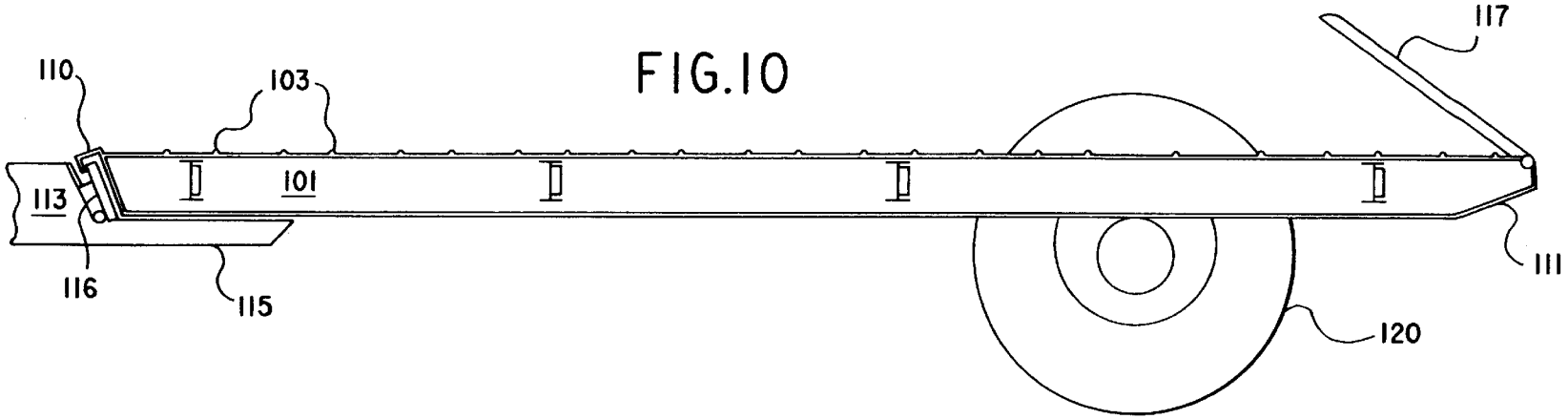
FIG. 10 shows a side view of the ramp of FIG. 9 and a portion of the detachable portion of the trailer.

FIGS. 9, 10 and 11 show the ramp-trailer 100 in detail. The ramp consists of two elongated beams 102 and 101 extending parallel to one another. On the top surface of each beam are portions 103, 104 extending upwardly from the surface to provide a semblance of treads which the corresponding treads of the crawler may engage as it crawls up the ramp to the top of the railroad car. Cross members 105, 106 and 107 connect the elongated beams and provide for strength and rigidity of the assembly. Mounted atop the cross members are retainer rails 108 and 109 which act as guides to equipments treads or tires as it crawls up the ramp to keep it from sliding off or tipping over. The forward ends of the elongated beams 101, 102 have hooked configurations as shown in all three figures.

The hooked portion consists of a top plate 110, a hooking plate 111 and the back plate 112. The configuration is designed to engage, as shown in FIG. 10, a corresponding section 116 having a portion to fit inside the hooked portion of 110 and constituting an extension of the trailer. The forward end 113 of the assembly when it is in trail configuration is shown in FIG. 15 which shows it with a trailer hitch 114 for engaging a standard hitch on a truck or utilizing a standard fifth wheel tractor trailer hitch.

FIG. 12 is a cross section taken along lines D—D of FIG. 9 and shows the relationship of the retainer rails 109 and 108 to the cross member 105 and elongated beams 101 and 102. The rendering is shown in relation to a track bed which shows the width relationship to the standard U. S. Track gauge of 4 feet 8 and one-half inches. As shown the beams and cross members are made of I-beams which give it strength and rigidity.

Figure 14:
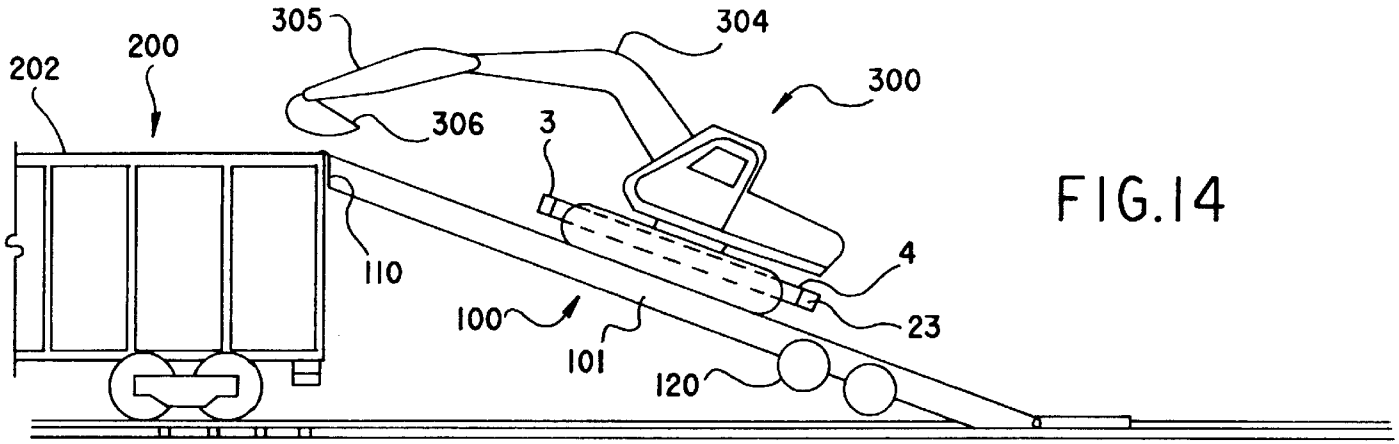
FIG. 14 shows the ramp in place and the equipment with the support frame attached moving up the ramp under its own power.
Figure 15:
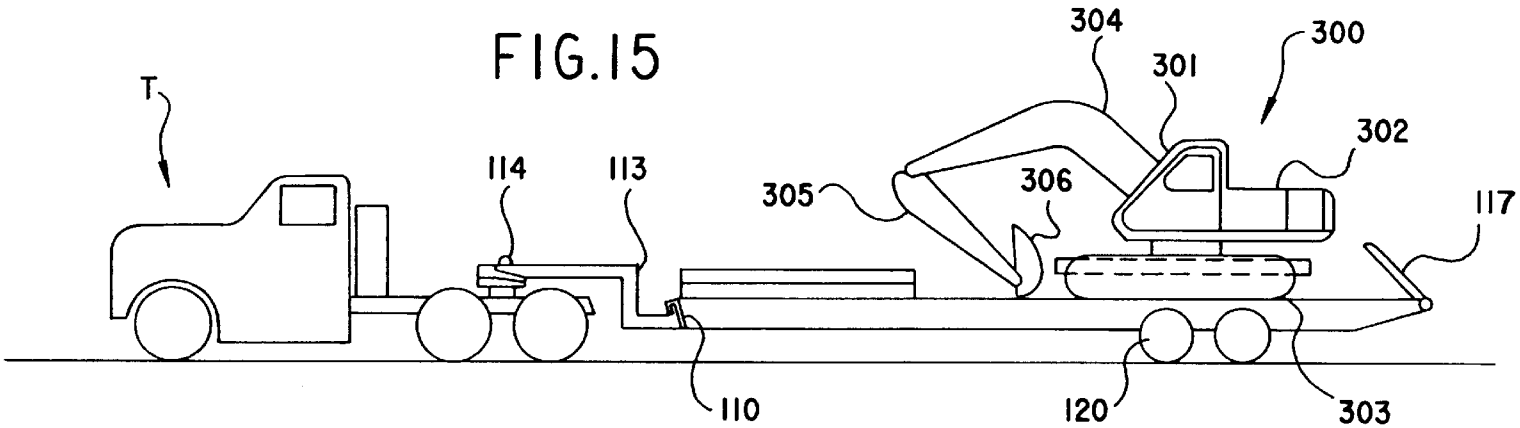
FIG. 15 shows the ramp assembled with its detachable trailer component and trailing the equipment behind a truck.

FIGS. 14 and 15 show the whole assembly ready for use. In FIG. 14 the ramp has been hooked onto the end lip of the car end (this is done by slinging the ramp end with a cable from the bucket and moving it into position. The main ramp portion has been unhooked from the trailer portion and the crawler is show ascending the ramp with the support frame in place as can be seen from the end view of outrigger beams 2 and 3 and a portion of beam 4. The crawler 300 is shown as having a cab portion 301 with an engine compartment 302, treads 303, a main arm 304, an extension arm 305 and a bucket 306. Once the crawler with its attached frame enters the area of the car top the ramp can be removed by another crawler and used to ascend other cars on different rail sidings. FIG. 15 shows the crawler 300 loaded onto the assembled trailer-ramp with portion 113 attached to the ramp 100. The whole assembly can be moved by being towed by truck T from one location to another quickly.

Figure 16:
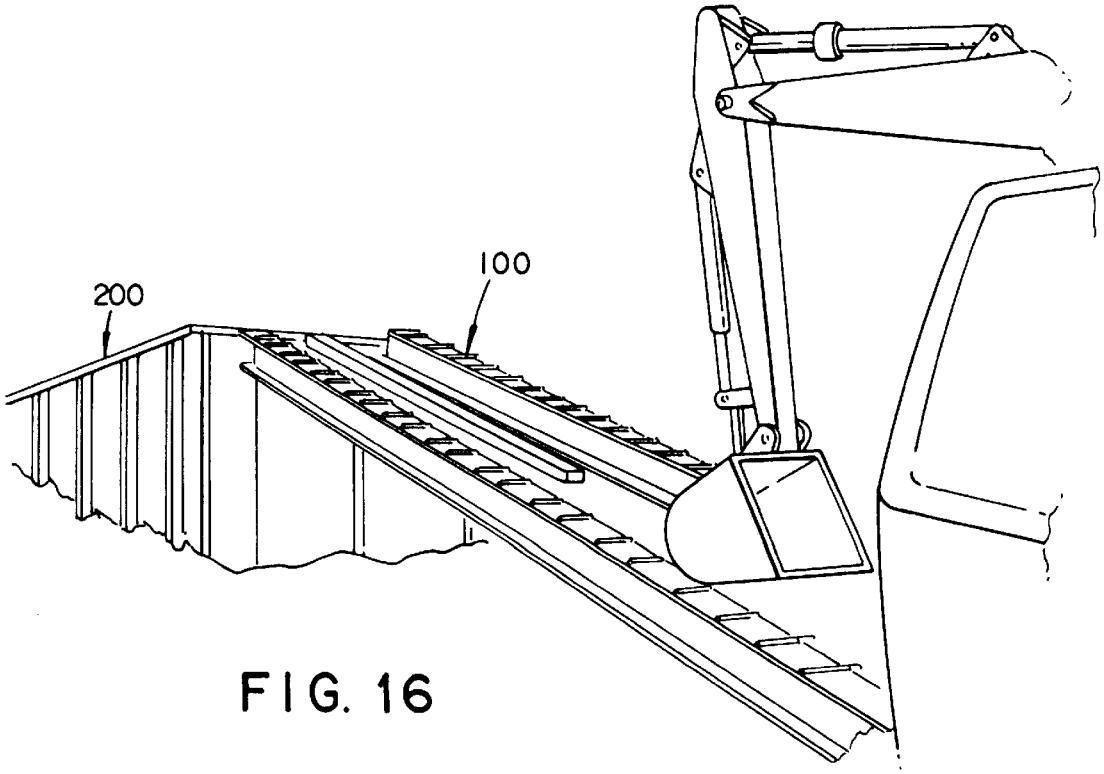
FIG. 16 is a picture of the ramp in place on the end of a coal car and the equipment starting up the ramp.
Figure 17:
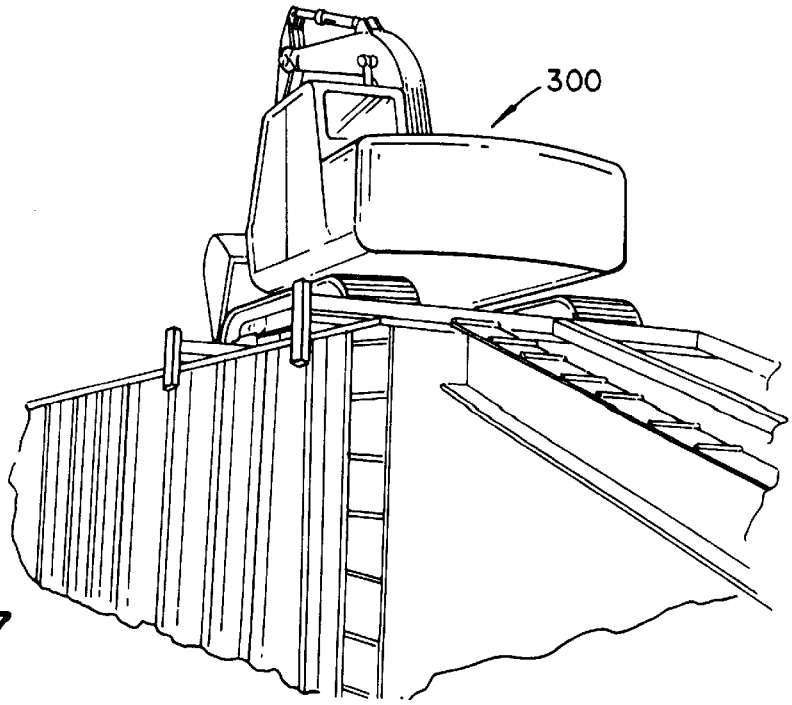
FIG. 17 is a picture of two pieces of equipment atop coal cars with the ramp in place.
Figure 18:
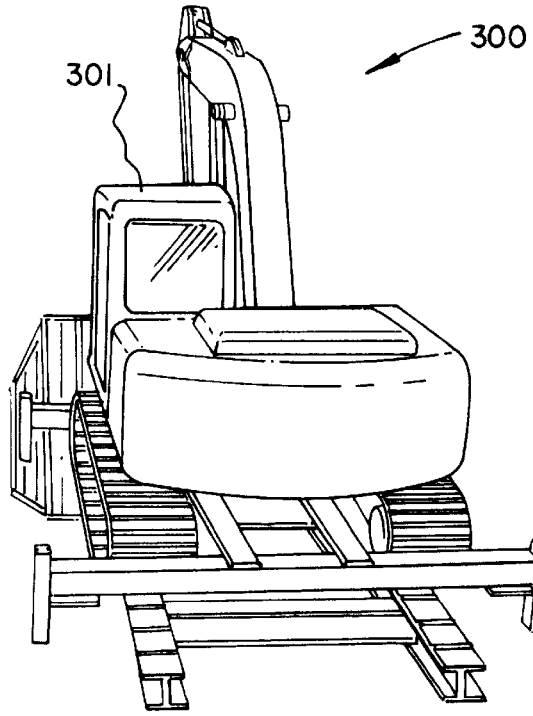
FIG. 18 shows the ramp in place on the end of a coal car and the crawler equipment moving up the ramp under its own power.

FIGS. 16, 17, 18 and 19 are a series of picture which show the invention in actual use unloading hopper cars. In FIG. 16 the ramp is show in place against the end of a first hopper car with the crawler about to ascend the ramp. FIG. 18 shows the crawler in the middle of the process of crawling up the ramp with its support from extending from underneath but not interfering with the movement thereof FIG. 17 shows the crawler atop the hopper car and in place. Note a second crawler already in place on a second hopper car in the process of unloading into a truck. A second truck in the background can be service by the crawler 300 as it moves along the car top.

Figure 19:
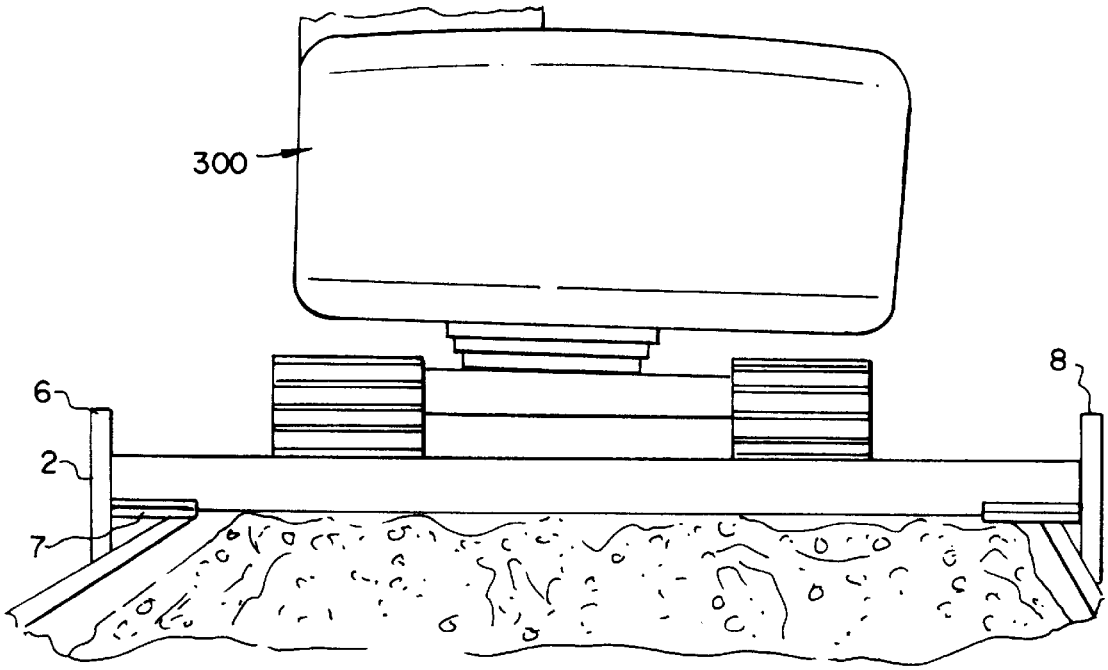
FIG. 19 shows detail of the outrigger beams and the equipment atop a hopper car.

Finally, FIG. 19 shows the view of the rear of the support frame once the crawler has attained position atop the car which is filled with coal tailings. The outrigger beam 2 is shown with its attendant end portions 6 and 7 and can be seen to be just engaging the tops of the car sides.

While only several illustrative embodiments have been shown in the disclosure herein, it will be obvious to those of ordinary skill in the art that many changes and modifications can be made without departing from the scope of the appended claims.

What is claimed is:

1. An apparatus for facilitating the quick, safe and efficient loading and/or unloading of an open top railroad car having reinforced sides such as a hopper car, said apparatus comprising an independently powered vehicle driven by an operator with at least one movable arm supported bucket for loading/unloading, said vehicle having a drive mechanism and drive members and being able to rotate on top of said mechanism and drive members to operate its bucket through 360 degrees to either side as well as to front and rear of itself, so that said vehicle can operate selectively to its front as well as its rear, and a sled attachment on said vehicle having skid means which have extending portions which extend from the sides thereof and which are either permanently or temporarily attached so as to provide a self-contained unit and to permit the drive members of the vehicle to operate in a first position where the vehicle is not atop the open railroad car but which is designed to engage the sides of said car when the vehicle is atop the car, and means on the end of said extending portions to keep said vehicle centered atop said railroad car and from lateral movement but while allowing forward and rearward movement, whereby said vehicle can skid forward and backward on said car to facilitate full unloading of said car on either side thereof without necessitating the operator leaving the vehicle and without danger of sliding sideways off said car.

2. An apparatus as in claim 1 wherein said powered vehicle is a crawler excavator with a hinged arm with a bucket on the end with tracked treads.

3. An apparatus as in claim 1 wherein said attachment is secured to the underside of the vehicle and extends substantially to the front and rear of said vehicle as well as to the sides so as to engage the top edges of the sides of the car.

4. An apparatus as in claim 3 wherein said extending portions have means by which the width of the attachment may be adjusted to accommodate the width of a specific type of railroad car such as different sized hopper cars.

5. An apparatus as in claim 1 wherein said means on the end of said extending portions has flanges adapted to abut the outsides of the car side and said skid means comprise skid plates whereby the whole assembly may be slid forward or backward atop the rail car.

6. A ramp apparatus for facilitating access to the top of open top railroad cars such as a hopper car by cargo loaders/unloaders, said ramp apparatus comprising a ramp assembly having an elongated rectangular shape with at least two elongated parallel surfaces running the length of said ramp assembly, said elongated surfaces facilitating the movement upwards of a cargo loading/unloading vehicle and providing an open space between said surfaces to allow a bucket on a crawler to engage the ground, and means on said ramp surfaces adapted to be engaged by treads of a crawler type vehicle, a hooking configuration portion at one end of said ramp assembly which is adapted to hook over the edge of a hopper car, and a trailing portion configured to engage said hooking configuration to provide a longer structure than the ramp assembly by itself, a tow hitch means on the forward end of said trailing portion, wheel means on said ramp assembly whereby the ramp assembly may attached to said trailing portion to thereby convert said ramp apparatus into a trailer for moving the assembly from one location to another, and whereby said ramp assembly may be hooked over the edge of a hopper car by said hooking configuration to facilitate movement of said loading/unloading vehicle up the ramp to work atop the car.

7. A ramp apparatus as in claim 6 and including retainer guides on top of said ramp assembly and adapted to guide the wheels and/or tracks of a loader/unloader vehicle up and down said ramp assembly to move on and off said rail car.

8. A ramp apparatus as in claim 6 and including a pivoting portion on the trailing end of said ramp assembly.

9. A system for loading and/or unloading discrete and/or fungible cargo from an open top railroad car with reinforced sides such as a hopper car, said system comprising an independently powered vehicle with at least one movable arm supported bucket for loading and/or unloading, said vehicle having a drive mechanism and drive members and being able to rotate at least its movable arm with the bucket through 360 degrees so as to operate its bucket to either side as well as to the front and rear of itself, a sled attachment on said vehicle having skid means having extending portions which extend from the sides thereof but are fixedly attached to said vehicle so as to permit the drive members of the vehicle to operate in a first position where the vehicle is not atop the rail car but which is designed to engage the side edges of said rail car when the vehicle is atop the car, said skid means permitting skidding movement of said vehicle and sled attachment along the tops of said open top railroad car, and means on the ends of said attachment extending portions adapted to maintain said vehicle centered atop said railroad car and to prevent lateral movement thereof, a trailer ramp assembly means designed to act both as a trailer for said vehicle and as a ramp for said vehicle by facilitating its movement to the top of an open topped railroad car, whereby said system is capable of easy movement to and from locations necessitating the loading and/or unloading of rail cars where no fixed loading and/or unloading facilities exist.

10. A system as in claim 9 wherein said trailer ramp assembly comprises two sections, the first section having an elongated rectangular shape with a hooking configuration on a portion thereof which is designed to engage with a complementary shaped configuration on the engaging portion of the second section, the second section having a trailer hitch means for engagement by a towing vehicle.

11. A system as in claim 10 wherein said trailer ramp assembly first section hooking configuration is adapted to engage the end top lip of an open top railroad car.

12. A system as in claim 9 wherein said attachment extending portions comprise at least two outrigger beams extending to the sides of said vehicle and being positioned on said attachment so as to be in front of and to the rear of the footprint of the vehicle.

13. A system as in claim 12 wherein said outrigger beams are adjustable so as to vary the width of said attachment.

14. A sled attachment for an unloading/loading vehicle which is independently powered with at least one movable arm supported bucket and having a drive mechanism with drive means, such as a tracked tread or wheels and being able to rotate at least its bucket arm through 360 degrees so as to operate on either side of itself as well as to either end where the arm is located, said attachment comprising a frame assembly having at least a pair of elongated members constituting a frame, at least a pair of outrigger beams extending laterally from said frame to engage the top edges of the rail car sides, the position of said beams being such that they are in front of and behind the vehicle when the attachment is secured thereto, skid means on each of said outrigger beams for engaging the tops of the sides of a railroad car to be loaded/unloaded by said vehicle, said outrigger beams being connected to said elongated members and the whole frame in a manner so as to allow said vehicle to move on its drive means when the vehicle is not atop the rail car and to engage the side top edges of the rail car by said skid means when the vehicle is atop the car, means on the upper side of said frame assembly for facilitating attachment to the underside of said vehicle, and means on the end of said outrigger beams to engage the sides of a railroad car to center said vehicle atop said car and to prevent lateral movement thereof.

15. An attachment as in claim 14 wherein said skid means are plates on the outer ends of said outrigger beams to facilitate the attachment sliding along the upper edges of the car sides.

16. An attachment as in claim 14 wherein said outrigger beams have adjustment means thereon whereby the width of said beams may be adjusted to accommodate different sized open topped railroad cars.

17. The method of unloading/loading an open top rail car with cargo of either fungible or discrete nature, said method comprising moving a tracked loader/unloader vehicle having skid means with a moveable arm supported bucket to a position atop the car, said tracked loader having an attached support member which allows said tracked loader/unloader to move forward and rearward, engaging the upper edge and sides of said railroad car as said tracked loader/unloader moves along the car while simultaneously skidding said tracked loader/unloader along the upper edges of said rail car on said skid means, and maintaining said tracked loader/unloader vehicle atop said car in a centered postion as it skiddingly moves along, loading or unloading said car with said bucket to either or both sides thereof while moving the vehicle along by pushing or pulling with its bucket.

* * * * *